United States Patent [19]

Korb

[11] Patent Number: 4,917,263

[45] Date of Patent: Apr. 17, 1990

[54] HOUSEHOLD CONTAINER ASSEMBLY WITH ADAPTABLE LID FOR A PLURALITY OF BAGS

[76] Inventor: Yaakov Korb, 23945 Mercantile Rd., Beachwood, Ohio 44122

[21] Appl. No.: 281,659

[22] Filed: Dec. 9, 1988

[51] Int. Cl.[4] ..... B65D 7/12

[52] U.S. Cl. ..... 220/404; 220/1 T; 220/400; 220/410

[58] Field of Search ..... 220/404, 403, 407, 410, 220/1 T, 400

[56] References Cited

U.S. PATENT DOCUMENTS

| | | | |
|---|---|---|---|
| 3,065,895 | 11/1962 | Lipschutz et al. | 220/403 |
| 3,101,839 | 8/1963 | Holman | 220/403 |
| 3,128,904 | 4/1964 | Reilly | 220/407 |
| 3,512,338 | 5/1970 | Nestler | 220/404 |
| 3,815,778 | 6/1974 | Martin | 220/404 |
| 3,888,406 | 6/1975 | Nippes | 220/1 T |
| 4,379,455 | 4/1983 | Deaton | 220/410 |
| 4,416,197 | 11/1983 | Kehl | 220/1 T |
| 4,610,358 | 9/1986 | Walter | 220/407 |
| 4,753,367 | 6/1988 | Miller et al. | 220/404 |

FOREIGN PATENT DOCUMENTS

| | | | |
|---|---|---|---|
| 2231582 | 12/1974 | France | 220/404 |
| 1271791 | 4/1972 | United Kingdom | 220/407 |
| 2071994A | 9/1981 | United Kingdom | 220/400 |

*Primary Examiner*—Stephen Marcus
*Assistant Examiner*—Stephen Castellano
*Attorney, Agent, or Firm*—Pearne, Gordon, McCoy & Granger

[57] ABSTRACT

A household container assembly includes an adapter so that it may hold and support 33-gallon disposable rubbish bags or 26-gallon disposable rubbish bags or both. The adapter fits on top of a container of the same size as a 33-gallon container and provides an opening of the same size as a 26-gallon container.

12 Claims, 2 Drawing Sheets

HOUSEHOLD CONTAINER ASSEMBLY WITH ADAPTABLE LID FOR A PLURALITY OF BAGS

BACKGROUND OF THE INVENTION

1. Field of the Invention

This invention relates to household containers of the type used for rubbish disposal, and more particularly to a container having a lid adapted to receive different sized disposable bags.

2. Description of the Prior Art

Rubbish or trash containers are commonly used in household and commercial locations as a receptacle for the collection of rubbish. Such containers are typically made of a rugged plastic material, but they may also be made of metal such as galvanized steel. While such containers may be used to directly collect rubbish, they more commonly are lined with a disposable plastic bag. These bags allow for the rubbish to be collected in the bag, and when the bag is full, for the bag to be removed from the container for disposal. When using these bags, the container acts primarily as a support for the bag. The bag is opened and placed in the container with the open end of the bag stretched around the top rim of the container. By pulling the open top of the bag over the lip of the top rim of the container, the bag is securely supported by the container.

Rubbish containers are available in a variety of sizes, the most common sizes being the 26-gallon size and the 33-gallon size. The 26-gallon size is more commonly used for heavier trash, such as printed matter. The 33-gallon size is used for lighter weight trash, such as yard leaves. Disposable bags for rubbish containers are likewise available in a variety of sizes, including a 26-gallon size for use with 26-gallon containers and a 33-gallon size for use with 33-gallon containers.

A consumer is likely to have a collection of rubbish containers of different sizes. The larger 33-gallon size container has certain advantages, particularly for lighter weight trash, such as leaves, and the 26-gallon size container has certain advantages, particularly for common household trash which is heavier in weight. With a collection of rubbish containers of different sizes, it is necessary for the consumer to have on hand a variety of different size disposable liner bags available. The 26-gallon bags will not fit in a 33-gallon container because the open end of the bag is not large enough to extend around the top rim of the container. While the 33-gallon bags fit in the smaller 26-gallon containers, the larger bags are cumbersome to use in the smaller containers, and since the larger bags are more expensive, the consumer wastes money.

A typical household or commercial establishment will have a variety of trash. Some weeks, there will be more lightweight trash, so that it would be more convenient to have a larger 33-gallon rubbish container. For example, in autumn, leaf collection is more conveniently handled in a 33-gallon rubbish container. Other weeks, there will be more heavier weight trash, so that it would be more convenient to have a smaller 26-gallon rubbish container.

For many people in apartments, condominiums, or smaller homes, there is insufficient room for more than one rubbish container. These people cannot take advantage of the separate advantages of the smaller 26-gallon rubbish containers and the larger 33-gallon rubbish containers.

SUMMARY OF THE INVENTION

The present invention combines the advantages of the smaller 26-gallon rubbish container with the larger 33-gallon in a single container assembly. With the container assembly of the present invention, it is possible to use either a 26-gallon liner bag or a 33-gallon liner bag. Thus a single container can be used with a 26-gallon bag for heavier weight trash or with a 33-gallon bag for lighter weight trash, and it is unnecessary to purchase and store two different size containers. Furthermore, the container assembly of the present invention can be used with two different sized bags simultaneously to provide convenient double bagging.

These and other advantages are provided by the present invention of a household container assembly. The assembly comprises a container having a top rim defining an opening at the top of the container. A first bag is located within the container. The first bag has an open end supported by attachment to the top rim of the container. An adapter partially curve the container opening. The adapter is removably attached to the top rim of the container. The adapter has an inner rim defining an opening of smaller dimension than the container opening. A second bag is located within the container. The second bag has an open end supported by attachment to the inner rim of the adapter. A lid is removably attached to the inner rim of the adapter and covers the adapter opening.

DETAILED DESCRIPTION OF THE PREFERRED EMBODIMENTS

Figure 1:
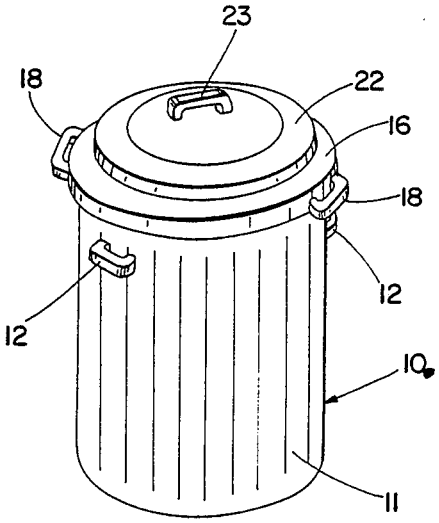
FIG. 1 is a perspective view of one embodiment of the household container assembly of the present invention.

Referring more particularly to the drawings, and initially to FIG. 1, there is shown the household container assembly 10 of the present invention. The container assembly 10 comprises a large receptacle or container 11 having an open top. The container 11 is preferably of about 33-gallon capacity, similar to that of standard 33-gallon rubbish containers, and is preferably formed of a rugged plastic material although other materials, such as galvanized steel, can be used. The container 11 is provided with handles 12 on both sides so that the container assembly 10 can be conveniently carried.

Figure 2:
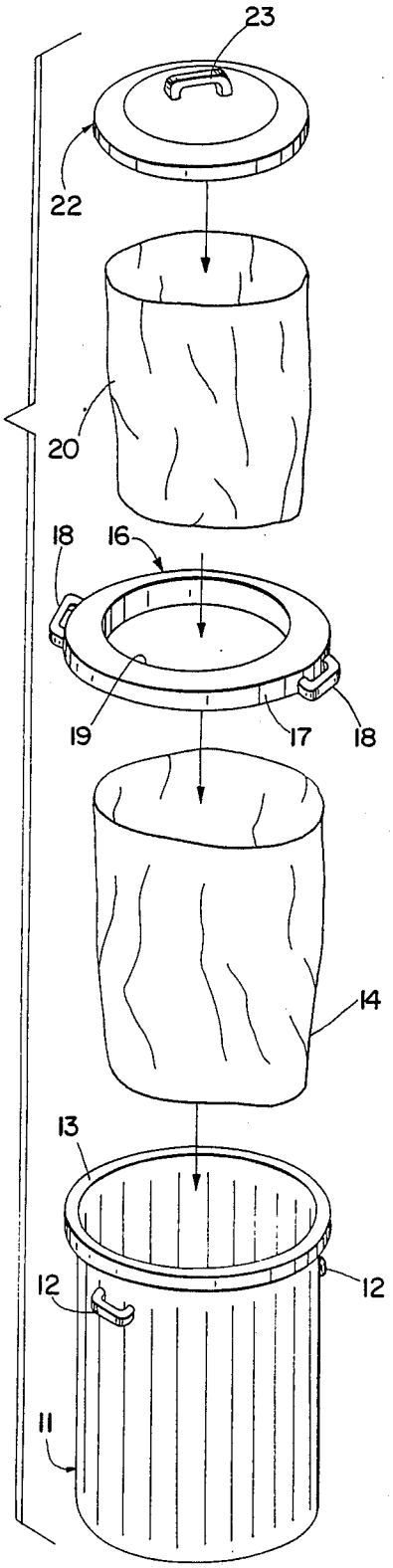
FIG. 2 is an exploded view of the household container assembly of FIG. 1.

As shown in FIG. 2, the container has a large opening at the top defined by a top rim 13. The container 11 should be similar or identical in shape and dimension to standard 33-gallon rubbish containers, with the diameter of the top rim 13 about the same as that of the standard 33-gallon containers, so that the container 11 can accept and support a 33-gallon trash bag 14. The bag 14 is a standard 33-gallon trash bag such as one typically used with a standard 33-gallon container. Since the diameter of the top rim 13 of the container 11 is like that of a standard 33-gallon container, the bag 14 may be supported in the container 11 by wrapping the edge of the bag at the open end over the rim 13 of the container in a conventional manner.

An adapter 16 is placed over the top rim 13 of the container 11. The adapter 16 is preferably formed of the same material as that of the container 11, such as a rugged plastic material, although other materials, such as galvanized steel can be used. The adapter 16 is generally annular in shape, and has an outer portion 17 that is similar in shape to a lid for a standard 33-gallon container.

The outer portion 17 of the adapter 16 is adapted to engage the top rim 13 of the container 11, so that the adapter is removably attached to the container. This attachment may be accomplished in any one of several suitable ways, such as an interlocking mechanism that allows a member on the outer edge of the adapter 16 to engage a corresponding member on the top rim 13 of the container 11, or a rotational engagement whereby a circumferentially disposed member on the outer edge of the adapter 16 engages a corresponding member on the top rim 13. Such mechanisms for removably attaching a lid to a container are well known in the art, and any such suitable mechanism may be used.

The outer portion 17 of the adapter 16 is provided with handles 18 on both sides, so that the adapter can be removed and so that the adapter can be easily handled to be attached to the container. Preferably, the handles 18 on the adapter 16 are located at 90 degrees with respect to the handles 12 on the container 11 so that they do not interfere with the use of the handles 12 on the container 11. When the adapter 16 is in place on top of the container 11, with the bag 14 supported in the container by wrapping the edge of the bag over the top rim 13 of the container, the bag is securely held in place by the engagement of the outer portion 17 of the adapter with the container top rim 13.

The inner portion 19 of the adapter 16 partially covers the opening in the top of the container 11 and provides an opening that is similar in shape and dimension to the top of a standard 26-gallon container. The opening in the adapter 16 is thus smaller in diameter than the opening in the container 11. Since the diameter of the opening in the inner portion 19 is about the same as that of the standard 26-gallon container, the adapter 16 can accept and support a 26-gallon trash bag 20. The bag 20 is a standard 26-gallon trash bag such as one typically used with a standard 26-gallon trash container. With the diameter and shape of the inner portion 19 of the adapter 16 like the top of a standard 26-gallon container, the bag 20 may be supported by the adapter by wrapping the edge of the open end of the bag over the rim of the inner portion 19 in a conventional manner.

A lid 22 covers the opening in the inner portion 19 of the adapter 16. The lid 22 is similar in size and shape to lids used with standard 26-gallon containers. The lid 22 is adapted to engage the inner portion 19 of the adapter 16, so that the lid is removably attached to the adapter. This attachment may be accomplished in any one of the several suitable ways, such as an interlocking mechanism that allows a member on the outer edge of the lid 22 to engage a corresponding member on the inner portion 19 of the adapter, or a rotational engagement whereby a circumferentially disposed member on the outer edge of the lid 22 engages a corresponding member on the adapter inner portion 19. As previously mentioned, such mechanisms for removably attaching a lid to a container are well known in the art, and any such suitable mechanism may be used. Preferably, the mechanism used to removably attach the lid 22 to the inner portion 19 of the adapter 16 is of a different type the mechanism used to removably attach the inner portion 17 of the adapter 16 to the top rim 13 of the container 11, so that the adapter is not inadvertently removed from the container while the lid is removed from the adapter, and so that the lid is not inadvertently removed from the adapter while the adapter is removed from the container. For example, if the mechanism for removably attaching the adapter 16 to the container 11 is of the rotational type, a non-rotational mechanism should be used for attaching the lid 22 to the adapter. Similarly if a rotational engaging mechanism is used for attach the lid 22 to the adapter 16, the mechanism used for attaching the adapter 16 to the container 11 should be non-rotationally engaging, such as a "snap on" mechanism. The lid 22 is preferably formed of the same material as that of the adapter 16 and the container 11, such as a rugged plastic material, although other materials, such as galvanized steel may be used.

When the lid 22 is in place on top of the adapter 16, and with the bag supported by wrapping the edge of the bag over the rim on the inner portion 19 of the adapter, the bag is securely held in place by the engagement of the outer rim of the lid with the inner portion of the adapter. A handle 23 is provided on top of the lid 22, so that the lid can be removed and so that the lid can be easily manipulated to be attached to the adapter.

In use, the household container assembly 10 of the present invention can be used in various ways. The container assembly 10 can be used as a conventional 33-gallon rubbish container by assembling all of the components of the assembly without the 26-gallon bag 20. The adapter 16 can be removed from the container 11 to install a new 33-gallon bag 14 and to remove the bag 14 when it becomes full. There is no need to remove the adapter 16 to put rubbish in the container. Rubbish can be deposited in the bag 14 by simply removing the lid 22. This assures that the bag 14 will not inadvertently come loose from the container 11, when rubbish is deposited because the adapter 16 remains in place securing the bag 14 to the container top rim 13.

The container assembly 10 can also be used as a conventional 26-gallon rubbish container by assembling all of the components of the assembly without the 33-gallon bag 14. The lid 22 is removed to install a new 26-gallon bag 20, to deposit rubbish in the bag, and to remove the bag when it becomes full.

If desired, a small support spacer or step may be placed in the bottom of the container 11 to reduce the volume of the container by about 7 gallons, so that bag 20 rests on the spacer. The use of such a spacer is desirable only when using inexpensive bags which might otherwise rip or tear without being properly supported on the bottom.

Alternatively, a differently shaped 26-gallon bag can be used. Such a bag would be longer and narrower in shape so that the bottom of the bag rests upon the bottom of the container 11, and the bag is supported thereby.

With the household container assembly 10 of the present invention, it is also possible to provide a simple and automatic way of providing double bagging by assembling the assembly with all of its components. In this way, the assembly operates as a 26-gallon rubbish container, but the 26-gallon bags are provided with an outer 33-gallon bag. This provides added protection in the event that the 26-gallon bag tears or breaks.

It can be seen that the household container assembly 10 of the present invention provides the capabilities of both a 26-gallon container and a 33-gallon container in a single assembly. Thus, the user can enjoy the advantages of the smaller 26-gallon rubbish container and the advantages of the larger 33-gallon container without purchasing two separate containers and without devoting the space necessary for storing two separate containers.

Figure 3:
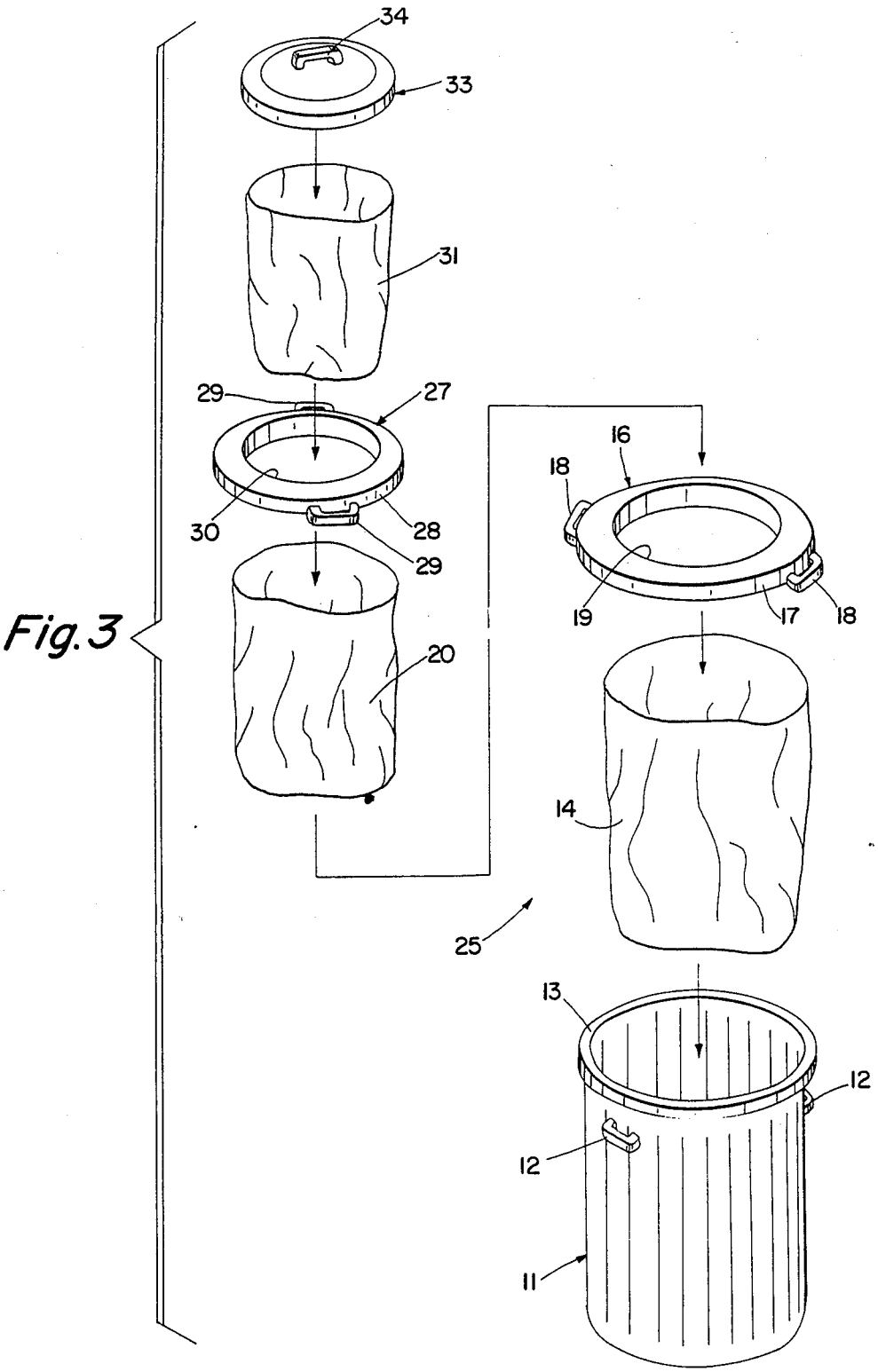
FIG. 3 is an exploded view of another embodiment of the household container assembly of the present invention.

FIG. 3 shows another embodiment of the household container assembly of the present invention. The container assembly 25 comprises a 33-gallon container 11 having an open top and provided with handles 12 on both sides so that the container assembly 25 can be conveniently carried. The container 11 has a large opening at the top defined by a top rim 13. The container 11 accepts and supports a standard 33-gallon bag 14. A adapter 16, which is placed over the top rim 13 of the container 11, is generally annular in shape, and has an outer portion 17 that is similar in shape to a lid for a standard 33-gallon container.

The outer portion 17 of the adapter 16 engages the top rim 13 of the container 11, so that the adapter is removably attached to the container. This attachment may be accomplished in any one of several suitable ways, as previously described. The outer portion 17 of the adapter 16 is provided with handles 18 on both sides, so that the adapter can be removed and so that the adapter can be easily handled to be attached to the container. When the adapter 16 is in place on top of the container 11, with the bag 14 supported in the container by wrapping the edge of the bag over the top rim 13 of the container, the bag is securely held in place by the engagement of the outer portion 17 of the adapter with the container top rim 13.

The inner portion 19 of the adapter 16 partially covers the opening in the top of the container 11 and provides an opening that is similar in shape and dimension to the top of a standard 26-gallon container, so that the adapter 16 can accept and support the 26-gallon trash bag 20. With the diameter and shape of the inner portion 19 of the adapter 16 like the top of a standard 26-gallon container, the bag 20 may be supported by the adapter by wrapping the edge of the open end of the bag over the rim of the inner portion 19 in a conventional manner.

A second adapter 27 is placed over the inner portion 19 of the first adapter 16. The second adapter 27 is preferably formed of the same material as that of the container 11 and the first adapter 16, such as a rugged plastic material, although other materials, such as galvanized steel can be used. The second adapter 27 is generally annular in shape, and has an outer portion 28 that is similar in shape to a lid for a standard 26-gallon container.

The outer portion 28 of the second adapter 27 is adapted to engage the inner portion 19 of the first adapter 16, so that the second adapter 27 is removably attached to the first adapter 16. This attachment may be accomplished in any one of several suitable ways, such as an interlocking mechanism that allows a member on the outer edge of the second adapter 27 to engage a corresponding member on the inner portion 19 of the first adapter 16, or a rotational engagement whereby a circumferentially disposed member on the outer portion of the adapter 27 engages a corresponding member on the inner portion 19. Such mechanisms for removably attaching a lid to a container are well known in the art, and any such suitable mechanism may be used.

The outer portion 28 of the second adapter 27 is provided with handles 29 on both sides, so that the second adapter can be removed and so that the second adapter can be easily handled to be attached to the first adapter and to the container. Preferably, the handles 29 on the second adapter 27 are located at 60 degrees with respect to the handles 12 on the container 11 and with respect to the handles 18 on the first adapter 16, so that they do not interfere with the use of the handles 12 and 18. When the second adapter 27 is in place on top of the first adapter 16, with the bag 20 supported in the container by wrapping the edge of the bag over the inner portion 19 of the first adapter 16, the bag is securely held in place by the engagement of the outer portion 28 of the second adapter with the first adapter inner portion 19.

The inner portion 30 of the second adapter 27 partially covers the opening in the top of the first adapter 16 and provides an opening that is similar in shape and dimension to the top of a standard 20-gallon container. The opening in the second adapter 27 is thus smaller in diameter than the opening in the first adapter 16. Since the diameter of the opening in the inner portion 30 is about the same as that of the standard 20-gallon container, the second adapter 27 can accept and support a 20-gallon trash bag 31. The bag 31 is a standard 20-gallon trash bag such as one typically used with a standard 20-gallon trash container. With the diameter and shape of the inner portion 30 of the adapter 27 like the top of a standard 20-gallon container, the bag 31 may be supported by the adapter by wrapping the edge of the open end of the bag over the rim of the inner portion 30 in a conventional manner.

A lid 33 covers the opening in the inner portion 30 of the second adapter 27. The lid 33 is similar in size and shape to lids used with standard 20-gallon containers. The lid 33 is adapted to engage the inner portion 30 of the second adapter 27, so that the lid is removably attached to the adapter. This attachment may be accomplished in any one of the several suitable ways previously described, such as an interlocking mechanism that allows a member on the outer edge of the lid 33 to engage a corresponding member on the inner portion 30 of the second adapter, or a rotational engagement whereby a circumferentially disposed member on the outer edge of the lid 33 engages a corresponding member on the adapter inner portion 30. As previously mentioned, such mechanisms for removably attaching a lid to a container are well known in the art, and any such suitable mechanism may be used. Preferably, the mechanism used to removably attach the lid 33 to the inner portion 30 of the adapter 27 is of a different type than the mechanism used to removably attach the outer portion 28 of the second adapter 27 to the inner portion 19 of the adapter 16, so that the second adapter is not inadvertently removed from the first adapter while the lid is removed from the second adapter, and so that the lid is not inadvertently removed from the second adapter while the second adapter is removed from the first adapter. For example, if the mechanism for removably attaching the second adapter 27 to the first adapter 16 is of the rotational type, a non-rotational mechanism should be used for attaching the lid 33 to the second adapter. Similarly if a rotational engaging mechanism is used to attach the lid 33 to the second adapter 27, the mechanism used for attaching the second adapter 27 to the first adapter 16 should be non-rotationally engaging, such as a "snap on" mechanism. The lid 33 is preferably formed of the same material as that of the adapters 16 and 27 and the container 11, such as a rugged plastic material, although other materials, such as galvanized steel may be used.

When the lid 33 is in place on top of the second adapter 27, and with the bag supported by wrapping the edge of the bag over the rim on the inner portion 30 of the second adapter, the bag is securely held in place by the engagement of the outer rim of the lid with the inner portion of the second adapter. A handle 34 is provided on top of the lid 33, so that the lid can be removed and so that the lid can be easily manipulated to be attached to the adapter.

In use, the household container assembly 25 can be used in various ways. The container assembly 25 can be used as a conventional 33-gallon rubbish container by assembling all of the components of the assembly without the 26-gallon bag 20 and the 20-gallon bag 31. The container assembly 25 can also be used as a conventional 26-gallon rubbish container by assembling all of the components of the assembly without the 33-gallon bag 14 or the 20-gallon bag 31. Finally, the container assembly 25 can be used as a conventional 20-gallon rubber container by assembling all of the components of the assembly without the 33-gallon bag 14 and the 26-gallon bag 20. The lid 33 is removed to install a new 20-gallon bag 31, to deposit rubbish in the bag, and to remove the bag when it becomes full.

With the household container assembly 25 of the present invention, it is also possible to provide a simple and automatic way of providing double bagging or triple bagging by assembling the assembly with all of its components. In this way, the assembly operates as a 20-gallon rubbish container, but the 20-gallon bags are provided with an outer 26-gallon bag or an outer 33-gallon bag or both. This provides added protection in the event that the 20-gallon bag tears or breaks.

It can be seen that the household container assembly 25 of the present invention provides the capabilities of a 20-gallon container, a 26-gallon container and a 33-gallon container in a single assembly. Thus, the user can enjoy the advantages of all three sized containers without purchasing three separate containers and without devoting the space necessary for storing three separate containers.

Various modifications may be made to the container assemblies 10 and 25 shown and described. For example, while the container assemblies have been shown with a cylindrical container 11, and a circular adapters 16 and 27 and circular lids 22 and 33, it is contemplated that a box-like container may be used with a square or rectangular adapter and lid.

Other modifications and variations are possible, all within the skill of the art. Accordingly, the invention is not to be limited to the particular embodiment shown and described herein nor in any other way that is inconsistent with the extent to which the progress in the art has been advanced by the invention. The invention has been shown and described herein with respect to a particular embodiment, but this is for the purpose of illustration rather than limitation, and other variations and modifications of the specific embodiment herein shown and described will be apparent to those skilled in the art.

What is claimed is:

1. A household container assembly which comprises:

a container having a top rim defining an opening at the top of the container;

a first bag located within the container, the first bag having an open end supported by attachment to the top rim of the container;

an adapter partially covering the container opening; the adapter being removably attached to the top rim of the container, the adapter having an inner rim defining an opening which is smaller than the container opening, the adapter helping to secure the open end of the first bag to the top rim of the container when the adapter is attached to the top rim of the container;

a second bag located within the container, the second bag having an open end supported by attachment to the inner rim of the adapter; and a lid removably attached to the inner rim of the adapter and covering the adapter opening, the lid helping to secure the open end of the second bag to the inner rim of the adapter when the lid is attached to the inner rim of the adapter;

whereby the first bag may be released by removing the adapter from the container without releasing the second bag, and the second bag may be released by removing the lid from the adapter without releasing the first bag.

2. A household container assembly as defined in claim 1, wherein the adapter has handles extending outwardly from the exterior of the adapter on each side.

3. A household container assembly as defined in claim 1, wherein the adapter secures the first bag by attachment to the container.

4. A household container assembly as defined in claim 1, wherein the open end of the second bag is smaller than the open end of the first bag.

5. A household container assembly as defined in claim 2, wherein the container also has handles extending outwardly from the exterior of the container on each side, the handles on the adapter being offset from the handles on the container.

6. A household container assembly which comprises:

a container having a top rim defining an opening at the top of the container;

a first bag located within the container, the first bag having an open end supported by attachment to the top rim of the container;

a first adapter partially covering the container opening; the first adapter being removably attached to the top rim of the container, the first adapter having an inner rim defining an opening which is smaller than the container opening, the first adapter helping to secure the open end of the first bag to the top rim of the container when the first adapter is attached to the top rim of the container;

a second bag located within the container, the second bag having an open end supported by attachment to the inner rim of the first adapter;

a second adapter partially covering the opening in the first adapter;

the second adapter being removably attached to the inner rim of the first adapter, the second adapter having an inner rim defining an opening which is smaller than the opening of the first adapter, the second adapter helping to secure the open end of the second bag to the inner rim of the first adapter when the second adapter is attached to the inner rim of the first adapter;

a third bag located within the container, the third bag having an open end supported by attachment to the inner rim of the second adapter, the lid being removably attached to the inner rim of the second adapter and covering the second adapter opening; and a lid removably attached to the inner rim of the second adapter and covering the second adapter opening, the lid helping to secure the open end of the third bag to the inner rim of the second adapter when the lid is attached to the inner rim of the second adapter;

whereby the first bag may be released by removing the first adapter from the container without releasing the second or third bags, the second bag may be released by removing the second adapter from the first adapter without releasing the first or third bags, and the third bag may be released by removing the lid from the second adapter without releasing the first or second bags.

7. A household container assembly as defined in claim 6, wherein the second adapter has handles extending outwardly from the exterior of the second adapter on each side.

8. A household container assembly as defined in claim 6, wherein the second adapter secures the second bag by attachment to the first adapter.

9. A household container assembly as defined in claim 6, wherein the open end of the third bag is smaller than the open end of the second bag.

10. A household container assembly as defined in claim 7, wherein the first adapter also has handles extending outwardly from the exterior of the first adapter on each side.

11. A household container assembly as defined in claim 10, wherein the container also has handles extending outwardly from the exterior of the container on each side, the handles on the first adapter being offset from the handles on the container.

12. A household container assembly as defined in claim 11, wherein the handles on the second adapter are offset from the handles on the first adapter and the handles on the container.

* * * * *